US007237771B2

(12) United States Patent
Lang et al.

(10) Patent No.: US 7,237,771 B2
(45) Date of Patent: Jul. 3, 2007

(54) FEEDER CONTROL SYSTEM AND METHOD

(75) Inventors: Joseph H. Lang, Webster, NY (US); Neil J. Dempsey, Victor, NY (US)

(73) Assignee: Xerox Corporation, Stamford, CT (US)

( * ) Notice: Subject to any disclaimer, the term of this patent is extended or adjusted under 35 U.S.C. 154(b) by 458 days.

(21) Appl. No.: 10/758,338

(22) Filed: Jan. 15, 2004

(65) Prior Publication Data

US 2005/0156370 A1 Jul. 21, 2005

(51) Int. Cl.
*B65H 3/44* (2006.01)

(52) U.S. Cl. ..... 271/9.01; 271/10.01; 271/11; 271/97; 271/98

(58) Field of Classification Search ..... 271/10.01, 271/11, 97, 98, 9.01, 9.05, 9.11, 9.12, 9.13; 399/388, 391
See application file for complete search history.

(56) References Cited

U.S. PATENT DOCUMENTS

| | | | | |
|---|---|---|---|---|
| 4,526,359 | A | 7/1985 | Garavuso | |
| 4,550,903 | A | 11/1985 | Moore | |
| 4,638,986 | A | 1/1987 | Huggins et al. | |
| 4,663,873 | A | 5/1987 | Shinbrot | |
| 4,673,286 | A | 6/1987 | Shinbrot | |
| 4,693,594 | A | 9/1987 | Garavuso et al. | |
| 4,727,402 | A | 2/1988 | Smith | |
| 5,048,813 | A | 9/1991 | Wierszewski et al. | |
| 5,062,602 | A | 11/1991 | Kress et al. | |
| 5,075,734 | A | 12/1991 | Durland et al. | |
| 5,126,790 | A | 6/1992 | Moore et al. | |
| 5,201,505 | A | 4/1993 | Shah | |
| 5,207,412 | A | 5/1993 | Coons, Jr. et al. | |
| 5,272,511 | A | 12/1993 | Conrad et al. | |
| 5,275,393 | A | 1/1994 | Cromie | |
| 5,356,127 | A | 10/1994 | Moore et al. | |
| 5,454,556 | A | 10/1995 | Siegel | |
| 5,835,839 | A | 11/1998 | Kaneda | |
| 6,015,146 | A | 1/2000 | Siegel | |
| 6,025,926 | A | 2/2000 | Smith et al. | |
| 6,264,188 | B1 | 7/2001 | Taylor et al. | |
| 6,352,255 | B1 | 3/2002 | Taylor | |
| 6,398,206 | B1 | 6/2002 | Yang et al. | |
| 6,398,207 | B1 | 6/2002 | Taylor et al. | |
| 6,398,208 | B1 | 6/2002 | Yang et al. | |
| 6,581,456 | B1 * | 6/2003 | Clark | 73/159 |

(Continued)

OTHER PUBLICATIONS

Canon NP 6551 Operator's Manual, Copyrigth 1997, pp. 1-16 through 1-23 and 4-2 through 4-22.*

*Primary Examiner*—David H Bollinger
(74) *Attorney, Agent, or Firm*—Fay Sharpe LLP

(57) ABSTRACT

A document forming apparatus, comprising a substrate feeder for storing and dispensing substrates to a printing engine, a controller for controlling the operation of the document forming apparatus, wherein the controller includes at least one database for storing information for the operation of the substrate feeder, and a user interface for controlling the operation of the document forming apparatus. The user interface includes a stock library view, a stock settings dialog screen having an expert feeder controls section with a manual mode operator and an auto mode operator, and a control panel screen for manual mode operation. The control panel screen includes means for adjusting a plurality of feeder parameters, indicators for manual and auto modes, and a save settings operator.

5 Claims, 7 Drawing Sheets

U.S. PATENT DOCUMENTS

2002/0070494 A1* 6/2002 Milillo et al. ..... 271/98
2002/0140157 A1 10/2002 Moore et al.
2003/0038960 A1 2/2003 Dempsey et al.
2004/0051229 A1* 3/2004 Clark et al. ..... 271/97
2004/0100013 A1* 5/2004 Mathewson ..... 271/98

* cited by examiner

80

Stock Library

Stock View

| Summary | Size | Color | Type | Weight |
|---|---|---|---|---|
| "Stock Name" | 8.5x11 | White | Plain | 120 gsm |
| "Stock Name" | 11x17 | White | Plain | 120 gsm |
| "Stock Name" | 8.5x11 | White | Plain | 120 gsm |
| "Stock Name" | 8.5x11 | Blue | Plain | 120 gsm |

FIG. 4

82

Stock Settings

"Stock Name"

Stock Attributes

Stock Name: ☐ Hidden

Icon and other information like tray info will be located within here.

Size: US letter (8.5x11in.)

Width: 216 (Range) Height: 279 (Range)

Color: White

Type: Plain

Modulus: 1 (Range)

Options:
☐ Drilled
☐ Exclusion

Grain: Long

Weight: 75 GSM (Range)

Sides Coated: None - 0

Coating Type: None

Finish: Regular

Stock Comments:

Delete OK Cancel

FIG. 5

FEEDER CONTROL SYSTEM AND METHOD

BACKGROUND

The present exemplary embodiment relates generally to an electrophotographic printing system. It finds particular application in conjunction with a sheet feeder control system and method for improving the feeding of copy sheets that accompanies this general process of copying and printing, and will be described with particular reference thereto. However, it is to be appreciated that the present exemplary embodiment is also amenable to other like applications.

In the process of electrophotographic reproduction, a light image of an original to be copied or printed is typically recorded in the form of a latent electrostatic image upon a photosensitive member, with a subsequent rendering of the latent image visible by the application of electroscopic marking particles, commonly referred to as toner. The visual toner image can be either fixed directly upon the photosensitive member or transferred from the member to another support medium or substrate, such as a sheet of plain paper. To render this toner image permanent, the image must be "fixed" or "fused" to the paper, generally by the application of heat and pressure.

With the advent of high speed xerography reproduction machines wherein copiers or printers can produced at a rate in excess of three thousand copies per hour, the sheet handling system must feed paper or other media through each process station in a rapid succession in a reliable and dependable manner in order to utilize the full capabilities of the reproduction machine. The sheet handling systems must operate flawlessly to virtually eliminate risk of damaging the recording sheets and generate minimum machine shutdowns due to misfeeds or multifeeds.

A high speed xerography reproduction machine typically includes a feeder assembly for feeding substrates to the image transfer portion of the machine. The feeder assembly may employ vacuum corrugated feeder technology, friction retard feeder technology, or shuttle feeder technology. The feeder typically has a fixed set of operating parameters. These settings may be the best compromise for feeding most types of substrates, and, as a result, the substrate feeding capability is generally limited to the range that these parameters allow. While this approach may satisfy the needs of general use copying/printing, it limits the range of substrates that can be fed in the production environment where expanded range is needed. Further, many of the users or operators in the production environment typically come from the offset lithography environment, and they are accustomed to "tuning" their machines for the substrates they are running. Offset lithography is the workhorse of printing. Almost every commercial printer employs it. And the quality of the final product is often due to the guidance, expertise and equipment provided by the printer.

Thus, there is a need for a feeder control system and method which provides the users of high speed xerographic machines the ability to adjust some of the feeder operating parameters to expand the range of substrates (from very light to heavy weight) that can be used with the machines.

BRIEF DESCRIPTION

According to one aspect of the exemplary embodiment, there is provided a document forming apparatus, comprising a substrate feeder for storing and dispensing substrates to a printing engine, a controller for controlling the operation of the document forming apparatus, wherein the controller includes at least one database for storing information for the operation of the substrate feeder, and a user interface for controlling the operation of the document forming apparatus. The user interface includes a stock library view, a stock settings dialog screen having an expert feeder controls section with a manual mode operator and an auto mode operator, and a control panel screen for manual mode operation. The control panel screen includes means for adjusting a plurality of feeder parameters, indicators for manual and auto modes, and a save settings operator.

According to another aspect of the exemplary embodiment, there is provided a method for operating a document forming apparatus having a substrate feeder, a user interface, and a controller. The method comprises receiving at the controller a signal that a user of the apparatus has activated a manual mode operator on a stock settings dialog screen on the user interface; in response to the signal, providing the user with a control panel screen for manually adjusting a plurality of operating parameters for the substrate feeder; receiving at the controller the adjusted feeder operating parameters; and where the user has activated a save selections operator on the control panel screen, saving the adjusted operating parameters in a plurality of databases on the controller.

BRIEF DESCRIPTION OF THE DRAWINGS

FIG. 4 illustrates a basic stock library view;

FIG. 5 illustrates a basic stock settings dialog screen;

DETAILED DESCRIPTION

Figure 1:
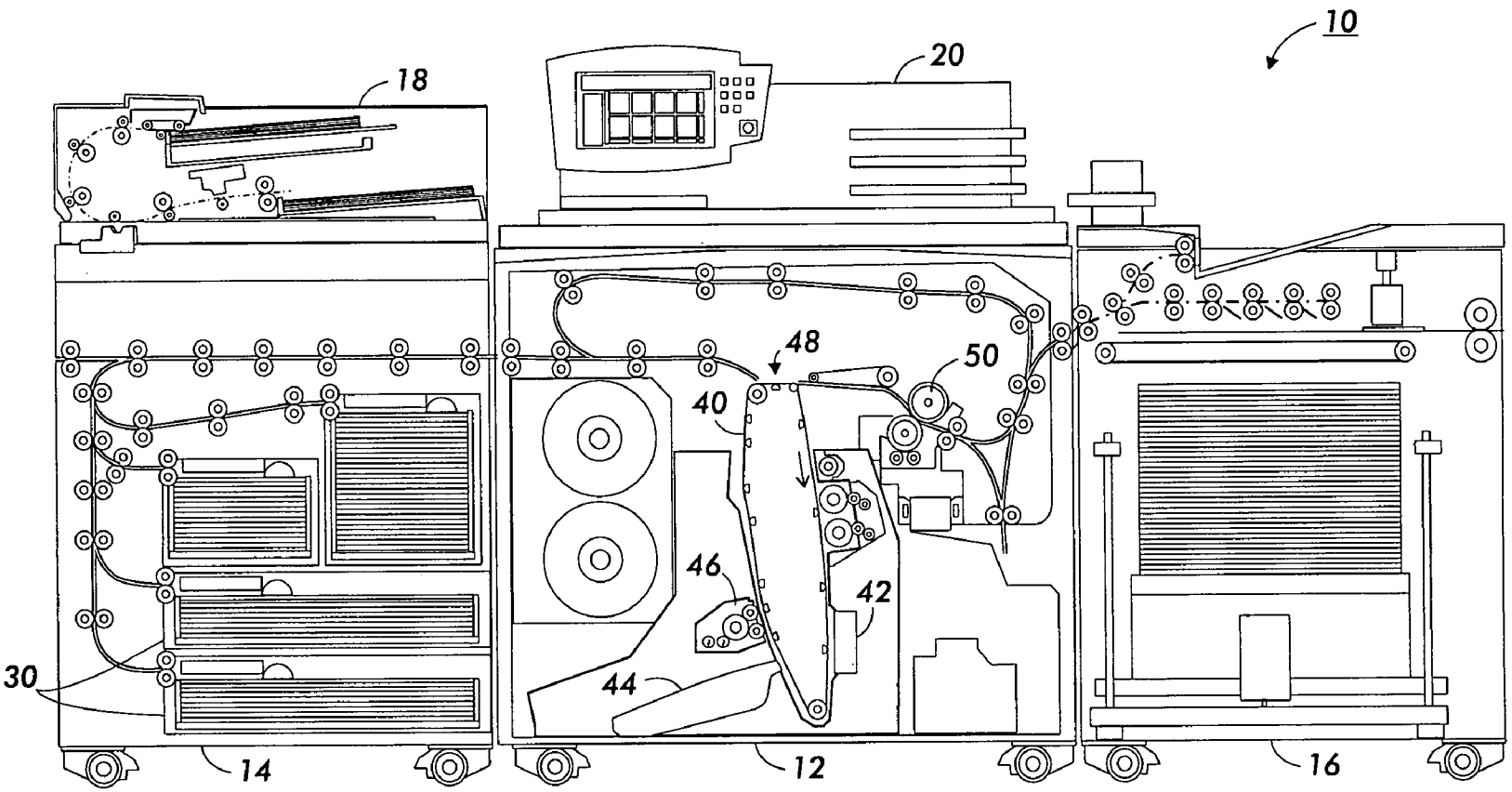
FIG. 1 is an elevational view showing the basic elements of a document forming apparatus incorporating aspects of the exemplary embodiment.

With reference to FIG. 1, there is shown an elevational view of a basic document creating apparatus 10 for creating documents and incorporating aspects of the present exemplary embodiment. Although the present exemplary embodiment will be described with reference to the single embodiment shown in the drawings, it should be understood that the present exemplary embodiment can be embodied in many alternate forms of embodiments. In addition, any suitable size, shape or type of elements or materials could be used. A copying or printing system of the type shown is preferably adapted to provide duplex or simplex stacked document sets from duplex or simplex collated document or print sets which result from either duplex or simplex original documents or output document computer files for print. The document creating apparatus 10, in the embodiment shown, is a copier. However, in an alternate embodiment, the apparatus could be a printer or any other suitable type of document creating apparatus.

In this embodiment, the apparatus 10 includes a printing engine 12, which includes hardware by which image signals are used to create a desired image, as well as a substrate feeder module 14, which stores and dispenses substrates (or sheets) upon which images are to be printed, and a finisher 16, which may include hardware for stacking, folding, stapling, binding, etc., prints which are output from the printing engine 12. It is to be understood, however, that although the feeder 14 is shown as a separate module, it may also be disposed within the printing engine 12 or some other part of the apparatus 10, as known in the art. If the apparatus 10 is also operable as a copier, the apparatus 10 further includes a document feeder 18, which operates to convert signals from light reflected from original hard-copy image into digital signals, which are in turn processed to create copies with the printing engine 12. The apparatus 10 may also include a local user interface 20 for controlling its operations, although another source of image data and instructions may include any number of computers to which the printer is connected via a network. The user interface 20 may include a touch screen for making selections or it can be operated by means of a keyboard and mouse.

With reference to the substrate feeder module 14, the module includes any number of feeder assemblies 30, each of which stores print sheets ("stock") of a predetermined type (size, weight, color, coating, transparency, etc.) in a tray and includes a feeder to dispense one of the sheets therein as instructed. The feeder may be a shuttle feeder, a vacuum corrugated feeder which utilizes air pressure to feed the sheets or other known types of feeders. Such feeders are generally known in the art and are described in various references, including U.S. Pat. Nos. 6,352,255, 6,264,188, and 5,356,127. Certain types of stock may require special handling in order to be dispensed properly. For example, heavier or larger stocks may desirably be drawn from a stack by use of an air knife, fluffer, vacuum grip or other application (not shown) of air pressure toward the top sheet or sheets in a stack. Certain types of coated stock are advantageously drawn from a stack by the use of an application of heat, such as by a stream of hot air (not shown) or other means. Sheets drawn from a selected tray 30 are then moved to the printing engine 12 to receive one or more images thereon.

In this embodiment, the printing engine 12 is a monochrome xerographic type, although other types of engine, such as color xerographic, ionographic, or ink-jet may be used. In FIG. 1, the printing engine 12 includes a photoreceptor 40, here in the form of a rotatable belt. The photoreceptor 40 is an example of what can be called a "rotatable image receptor," meaning any rotatable structure such as a drum or belt which can temporarily retain one or more images for printing. Such an image receptor can comprise, by way of example and not limitation, a photoreceptor, or an intermediate member for retaining one or more ink or toner layers for subsequent transfer to a sheet, such as in a color xerographic, offset, or ink-jet printing apparatus. The photoreceptor 40 is entrained on a number of rollers, and a number of stations familiar in the art of xerography are placed suitably around the photoreceptor 40, such as a charging station 42, an imaging station 44, a development station 46, and a transfer station 48. In this embodiment, the imaging station 44 is in the form of a laser-based raster output scanner, of a design familiar in the art of "laser printing," in which a narrow laser beam scans successive scan lines oriented perpendicular to the process direction of the rotating photoreceptor 40. The laser is turned on and off to selectably discharge small areas on the moving photoreceptor 40 according to image data to yield an electrostatic latent image, which is developed with toner at the development station 46 and transferred to a sheet at the transfer station 48.

A sheet having received an image in this way is subsequently moved through a fuser 50, of a general design known in the art, and the heat and pressure from the fuser causes the toner image to become substantially permanent on the sheet. For duplex or two-sided printing, the printed sheet can then be inverted and re-fed past the transfer station 48 to receive a second-side image. The finally-printed sheet is then moved to finisher module 16, where it may be collated, stapled, folded, etc., with other sheets in methods familiar in the art.

There are also various motors that feed sheets from a stack in the feeder assembly 30 through the machine that can be readily controlled, whether they are AC, DC, or servo motors, to operate at a certain speed, depending on the desired output speed, which of course directly affects the rotational speed of the photoreceptor 40.

The substrate feeder module 14 has many control parameters that are "fixed" during the design stage along with some that are variable and controlled through the machine software. The variable control parameters include the fluffer air pressure, the vacuum level, whether the air supply heater is on or off, the stack height, and timing. These variables are normally controlled by the printing engine 12 to some pre-set values determined by testing during product development and will be described in greater detail below.

Figure 2:
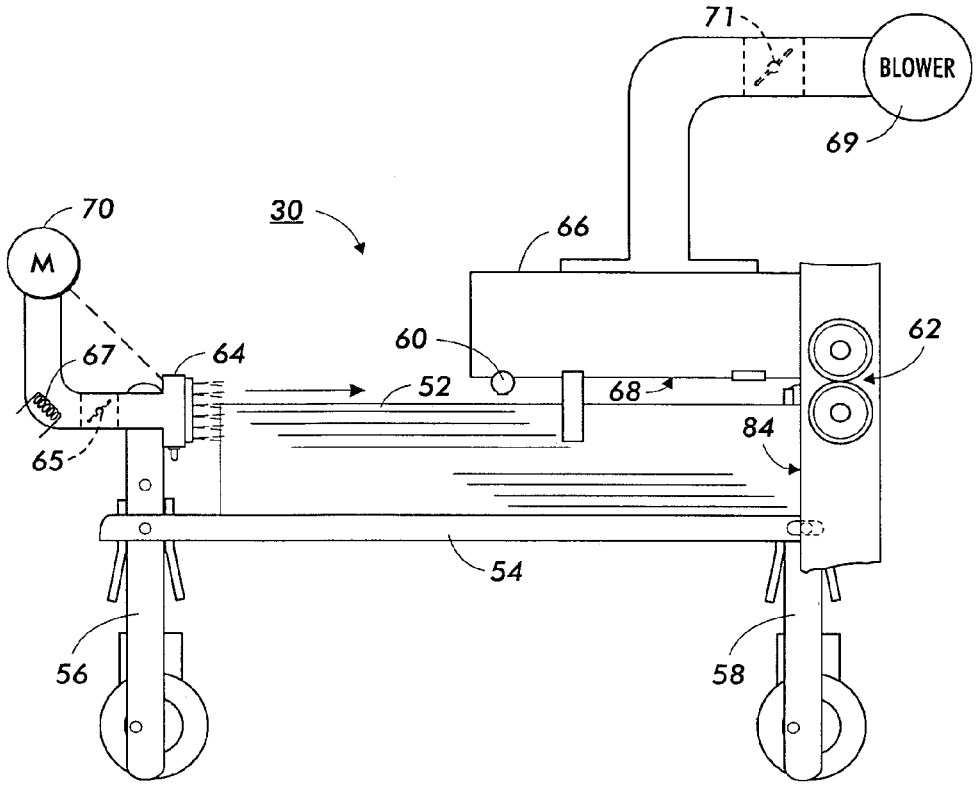
FIG. 2 is a side view illustrating the feeder assembly.

With reference to FIG. 2, there is shown a side elevational schematic view of a basic feeder assembly 30, incorporating aspects of the present exemplary embodiment. The basic components of the feeder assembly 30 include a stack of sheets 52 in a sheet support tray 54, multiple tray elevators 56, 58, a stack height sensor 60, a take away roll 62, at least one sheet fluffer (or blower) 64, and a vacuum feed head 66. The feed head 66 includes an acquisition surface 68. The fluffer 64 blows air at the top sheets of paper in the stack 52. This is done to separate the sheets from the stack 52 and to make them more easily acquired by the feed head 66. The air pressure of the fluffer 64 is typically controlled to a predetermined value. The speed of the blower motor 70 for the tray 54 is preset via the brushless DC blower motor input voltage level, while the air flow is metered through a stepper controlled restriction valve 65 to different levels. These levels correspond to the levels needed for light to heavy weight paper requirements.

The substrate feeder module 14 includes a heater 67 for preheating the fluffer air and assisting in sheet separation. The heater is generally enabled to be turned on and off, since they are only allowed to be "on" if air is moving through them.

The substrate feeder module 14 preferably employs shuffle feeder technology, which at a simplified level is merely using vacuum corrugated feeders that physically translate the sheet from the stack to the takeaway rolls. The vacuum feed level is a significant feeding control parameter. For example, the vacuum may be supplied from individual brushless DC blowers 69 for each feed head 66. There is typically a stepper motor controlled vacuum valve 71 in the vacuum duct between the fluffer 64 and the feed head 66, which throttles down or restricts the amount of air that is available at the feed head 66. This is generally machine controlled, and it is virtually continuously adjustable. The feed vacuum level may be controlled through the vacuum valves.

There may be a two-level approach for substrate feeding: automatic (or auto) and manual modes. As described earlier, the feeders are automatically controlled to pre-set values of the control parameters determined by testing during product development. This is the default mode of operation and is displayed on the user interface 20 and would satisfy the normal customer needs. On the other hand, manual mode enables the user to manually adjust the fluffer air pressure, the feeder vacuum level, heater on/off, the stack height, timing, as well as other control parameters. When selecting manual mode on the user interface 20, the user would be able to set these additional values for these parameters to optimize in the feeding performance for the particular paper they are running.

Figure 3:
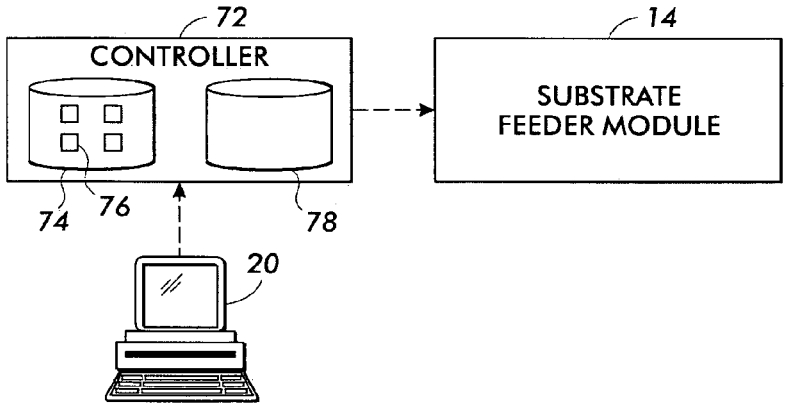
FIG. 3 is a block diagram illustrating the controller.

Regarding the "auto" mode, reference is now made to FIG. 3, wherein a controller 72 for controlling the substrate feeder module 14 of the apparatus 10 via the user interface 20 is shown in schematic form. The controller 72 may include a media library database 74 (sometimes called a paper/media or substrate catalog as well as stock library), which has a number of memory registers 76 for storing stock (paper) attributes, as well as a feeder capabilities and constraints database 78. It is to be understood, however, that the functions of the two databases 74, 78 may be combined into one database. The attributes are generally entered by the user so that the product (feeder) performance can be automatically set for best performance. A typical stock library view 80 to the general operator or user is illustrated in FIG. 4. As shown in that figure, each type of stock may be defined by its size, color, type, and weight, although other stock characteristics may be used.

For any stock in the stock library, such as 8.5×11 inch, plain, white paper, a variety of parameters may be specified to more accurately describe the stocks that are available to be printed on, including size (width and height), color, type, modulus, grain, weight, coating, and finish, among others. A typical stock settings dialog screen 82 is illustrated in FIG. 5. The user may enter all the attributes for the particular stock he or she desires to run. These paper attributes are stored in the memory registers 76 associated with each paper in the stock library.

Feeder (tray) programming is responsible for programming the paper media attributes of a feeder module or paper tray. Feeder capabilities and constraints are stored in the feeder capabilities and constraints database 78 on the controller 72.

Once a media library exists, the user can now assign a paper from the media library to either a specific paper tray in the printer or simply request that the machine determine which tray the stock is in and automatically feed from that tray. This may be accomplished through the user interface 20.

The basic sheet feeding process is generally known in the art and is described in U.S. Patent Application Publication No. 2002/0140157, for example. With reference to FIG. 2, to begin the sheet feeding cycle, the tray elevators 56, 58 will generally lift the top of the stack 52 within a predetermined spacing to the bottom of the feed head 66 (i.e., the "stack height"), depending on the basis weight input. For heavy weight papers, the stack height is generally brought closer to the feed head 66 because its added mass causes it to be levitated less by the fluffer 64 than a light weight sheet.

Once the stack has been placed in the correct position, a blower will be activated to use a combination of heated air and air pressure, blown into the side of the stack 52, to separate the uppermost sheets in the stack. Fluffers may be on three sides of the stack. Forced air from the fluffer nozzles acts to create an air bearing between the sheets to lower the coefficient of friction between sheets and decrease the chance of multiple feeds. The fluffer pressure can be increased or decreased to fine tune the sheet separation for sheet size and weight for a particular stack height setting. For small light papers, fluffer pressures are reduced from nominal. For large heavy sheets, fluffer pressure is increased from nominal.

Heating elements are placed inside the fluffer duct (not shown) in a high temperature resistant section of the duct. The air is heated to a temperature that is above the temperature inside the module. The heaters are turned on for all coated paper types run regardless of relative humidity to aid in sheet separation.

After this preliminary sheet separation occurs, vacuum pressure is applied to the feed head 66 and one or more sheets are pulled up to the bottom of the feed head 66. The contour on the acquisition surface 68 (i.e., the bottom) of the feed head 66 typically has a corrugation pattern built in, which acts to bend the uppermost sheet in a manner that is difficult for the second sheet to duplicate. After the corrugation pattern has induced areas of separation between the sheets, if multiple sheets were attracted to the feed head 66, the sheet separation phase begins.

The fluffer 64 and the feed head corrugation pattern perform initial sheet separation. If both of these methods fail and multiple sheets are still acquired by the feed head, an air knife and fangs (not shown) may be used to separate sheets and retain remaining fluffed sheets. The air knife shoots air into the baffle on front of the feed head. The baffle reflects that pressure into any air gaps caused by the corrugation pattern to break any bleed through vacuum forces and also down upon the lead edge of the remaining fluffed sheet to retain the stack. This reflection provides localized high pressure areas that occur near the paper stops to prevent remaining sheets from being fed. Each feeder 30 has variable air knife pressure settings. For small, light sheets, air knife pressure is reduced from nominal. For large, heavy sheets, air knife pressure is increased from nominal.

Approximately 115 msec after the vacuum turns on to start the feed process, the lead edge 84 of the sheet must move horizontally from above the stack a distance of 16 mm forward to a point 5 mm past the take away roller 62 nip. The feed head 66 must move forward and retract within 152 msec. The feed head vacuum is turned off when the lead edge 84 of the sheet arrives at the take away roller 62. The air knife will also exert a residual pressure on the lead edge 84 of the sheet. The take away roller 62 must overpower this residual feed head vacuum to advance the sheet. The residual air knife pressure must be low enough not to force the lead edge 84 of the sheet down during transfer thereby causing paper stop jams or misfeeds.

The feeder 30 will have different feed rates or feed cycle times, depending on the length of sheet in the process direction, as shown in Table 1 below:

TABLE 1

| Sheet Length (mm) | Sheet Length (in) | Feed Rate (pages per minute) | Feed Cycle Time (msec) |
|---|---|---|---|
| 182-297 | >7.17-11.7 | 133 | 451 |
| 298-432 | >11.7-17.0 | 100 | 600 |
| 433-470 | >17.0-18.5 | 66 | 909 |

When a sheet of paper is fed, the feeder goes through a cycle up sequence, a feed sequence and then a cycle down sequence. During feeding, the paper location in the paper path is monitored to detect if a jam has occurred. When an user selects a set of paper characteristics or specific paper from the paper catalog, the attributes in the paper catalog memory register are read by the machine control software and are used to set the feeder components operation set points. The set points are sent to the feeder control board, which in turn controls the feeder elements. This results in the set of operating parameters in auto mode, which is the typical mode of operation of the apparatus 10.

Figure 6:
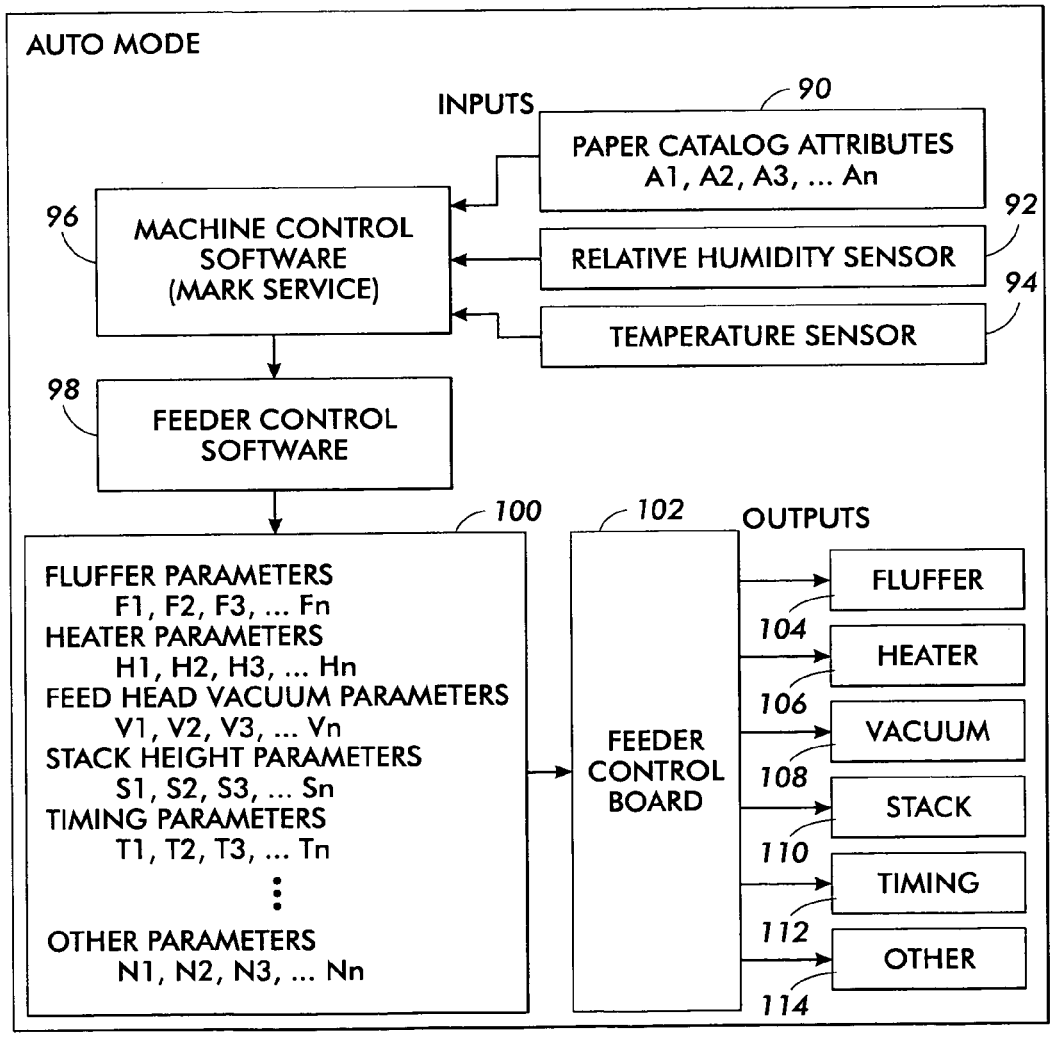
FIG. 6 is a flow chart of the feeder control process in auto mode.

FIG. 6 is a flow chart illustrating auto mode for feeder control. The inputs include paper catalog attributes 90, relative humidity 92, and temperature 94. These inputs are transmitted to the machine control software 96 for processing. The output is then transmitted to the feeder control software 98 to determine the feeder parameters 100, which include fluffer parameters, heater parameters, feed head vacuum parameters, stack height parameters, timing parameters, and other parameters. These parameters 100 are transmitted to the feeder control board 102, whereby the feeding elements, including fluffer pressure 104, heater status 106, vacuum level 108, stack height 110, timing 112, and other elements 114, as described above, are automatically adjusted.

Figure 7:
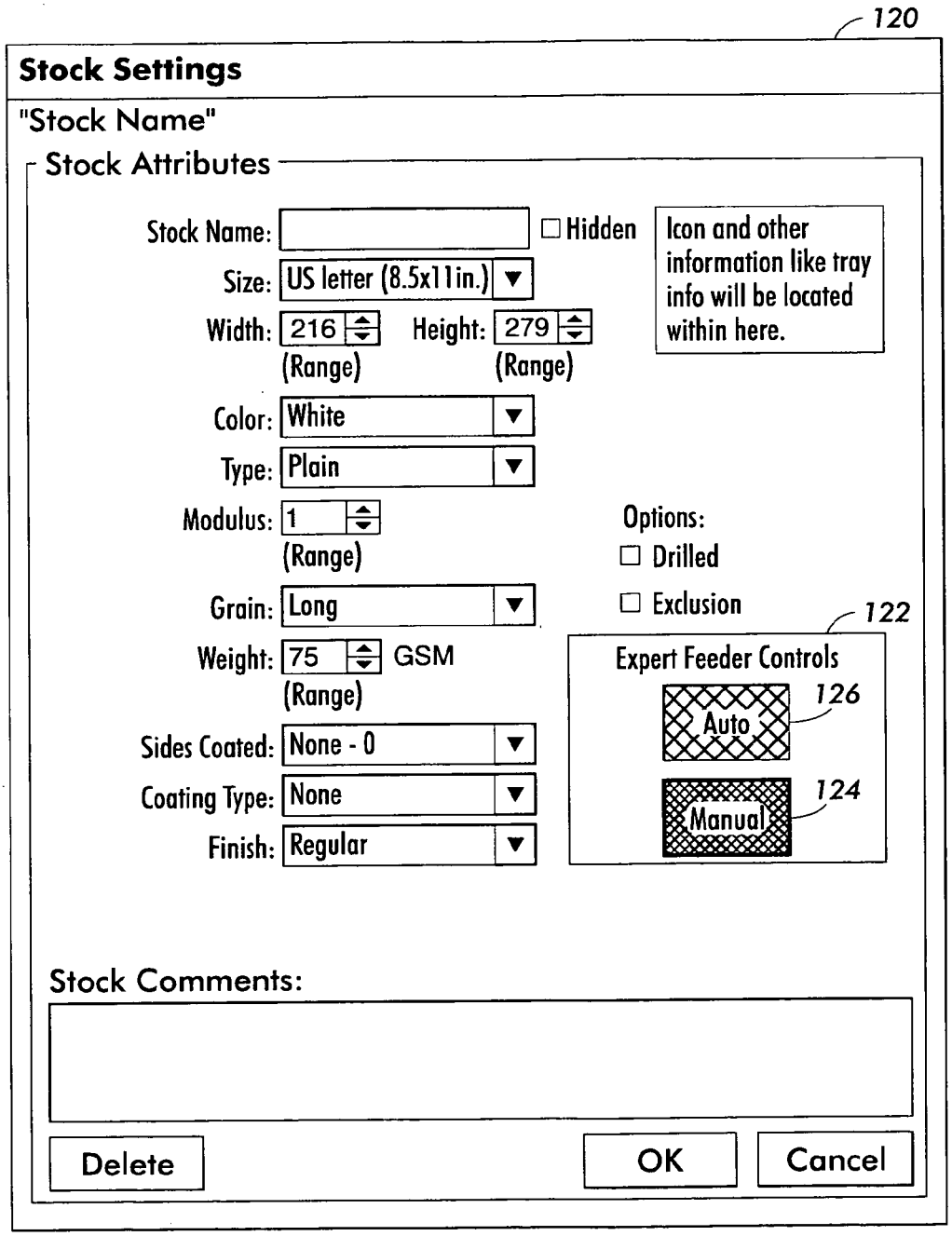
FIG. 7 illustrates a stock settings dialog screen in accordance with aspects of the exemplary embodiment.

The apparatus 10 is typically optimized to be able to feed the widest range of stocks, using a single set of predetermined control factors or settings. However, a knowledgeable user may be wish to fine tune the system to feed various types of stocks. Thus, the standard stock settings dialog screen may include a "manual" mode. With reference to FIG. 7, a modified stock settings dialog screen 120 includes an "Expert Feeder Controls" section 122, containing a "manual" (or "expert") mode operator 124 for making a selection, in addition to an "auto" mode operator 126. These operators 124, 126 may be activated by means of a mouse and/or keyboard, as well as through a touch screen.

Figure 8:
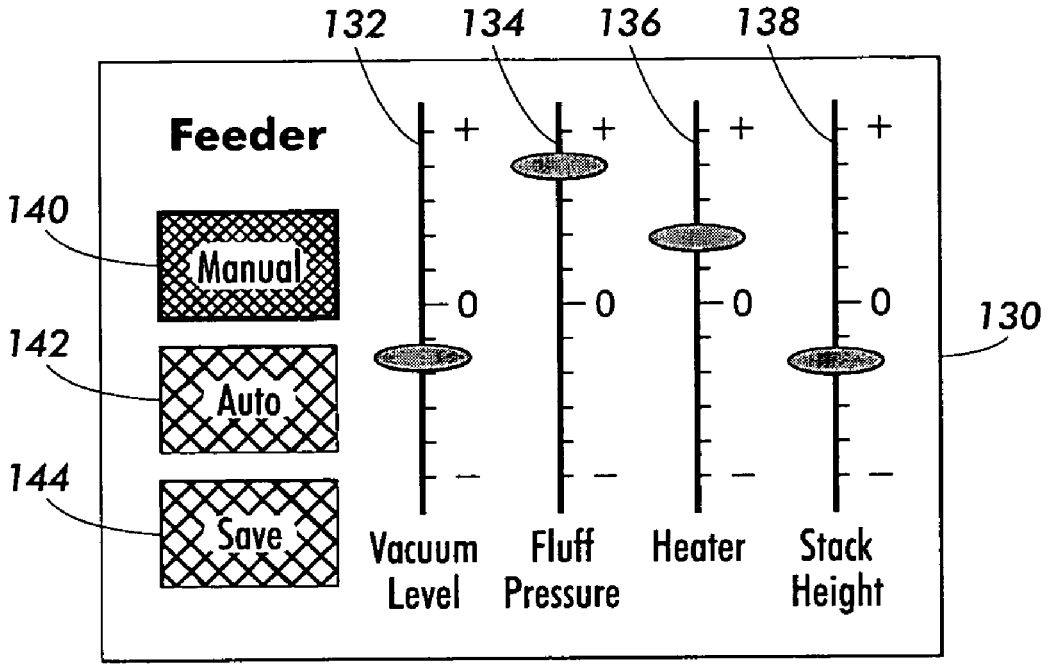
FIG. 8 illustrates a manual feeder control pop-up screen.

When the manual mode operator 124 is activated, a control panel pop-up 130, as shown in FIG. 8, appears so that the user may modify the existing feeder parameters. The control panel 130 may be part of the stock settings dialog screen 120 or it can be a separate screen. The control panel 130 displays the auto levels for each of the feeder parameters when it is first opened. The user has the option of adjusting any of the parameters displayed—such as the vacuum level 132, the fluff pressure 134, the heater 136, and the stack height 138—to fine tune the feeder performance for the particular stock being run. The "manual" indicator 140 stays highlighted during the adjustment process, while the "auto" indicator 142 is not highlighted. Once a set of parameters is decided upon, the user may save these settings by pressing the "save" operator 144. When this is done, the control panel 130 closes, and the manual mode operator 124 stays highlighted on the stock settings dialog box 120, indicating that special settings have been made.

When feeder settings are made manually and saved, these settings are appended to the media library database 74 and the feeder capabilities and constraints database 78 so they can be recalled and fed to the controller 72 to modify the feeder parameters whenever this type of stock is run again. Thus, users save time because they can save the settings once they have been determined so that they can quickly go back to them when they use that stock again. Further, the manual mode expands the media range available to users.

The present exemplary embodiment may also be used to control other aspects of the machine operation affected by the stock, such as fuser temperature increase for rough stock, decurler setting changes for single-side coated stocks. The present exemplary embodiment can be used for making adjustments to many different applications within the apparatus 10.

The exemplary embodiment has been described with reference to the preferred embodiments. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A document forming apparatus comprising:

a substrate feeder for storing and dispensing substrates to a printing engine;

a controller for controlling the operation of the document forming apparatus, the controller including a media library database and a feeder capabilities and constraints database for storing information for the operation of the substrate feeder;

a user interface for controlling the operation of the document forming apparatus, the user interface including a stock library view, a stock settings dialog screen having an expert feeder controls section with a manual mode operator and an auto mode operator, and a control panel screen for manual mode operation, the control panel screen including means for adjusting a plurality of feeder parameters, indicators for manual and auto modes, and a save settings operator.

2. The document forming apparatus defined in claim 1, wherein the substrate feeder includes a plurality of feeder assemblies, wherein each feeder assembly comprises a tray for holding a stack of substrates, a plurality of tray elevators, a plurality of fluffers, a motor, a plurality of heaters, a feed head vacuum, and a take away roll.

3. The document forming apparatus defined in claim 2, wherein the feeder parameters include at least one of vacuum level, fluffer pressure, heater status, and stack height.

4. The document forming apparatus defined in claim 1, wherein the media library database includes a plurality of memory registers for storing substrate attributes.

5. The document forming apparatus defined in claim 1, wherein the feeder parameters include at least one of fuser temperature and decurler settings.

* * * * *